US007788954B2

(12) United States Patent
Schumm

(10) Patent No.: US 7,788,954 B2
(45) Date of Patent: Sep. 7, 2010

(54) DOOR PANEL INTEGRATED DOOR STOPPER WITH OPERATING MECHANISM INTEGRATED INTO THE DOOR LOCK HOUSING

(76) Inventor: Hermann Schumm, Kreuzweg 8, 74599 Wallhausen-Michelbach (DE)

( * ) Notice: Subject to any disclaimer, the term of this patent is extended or adjusted under 35 U.S.C. 154(b) by 562 days.

(21) Appl. No.: 11/601,378

(22) Filed: Nov. 17, 2006

(65) Prior Publication Data

US 2008/0115545 A1 May 22, 2008

(51) Int. Cl.
*E05B 59/00* (2006.01)

(52) U.S. Cl. ..... 70/107; 292/41; 292/DIG. 15; 70/111

(58) Field of Classification Search ..... 292/34, 292/38, 41, DIG. 15, 348; 70/101, 107, 108–111; 16/82

See application file for complete search history.

(56) References Cited

U.S. PATENT DOCUMENTS 595,505 A * 12/1897 Wesling ..... 292/167
903,409 A * 11/1908 Schneider ..... 292/175
1,172,205 A * 2/1916 Gillentine ..... 292/255
2,726,109 A * 12/1955 Bennett ..... 292/167
4,621,848 A * 11/1986 Pierce ..... 292/336.3
5,524,942 A * 6/1996 Fleming ..... 292/34
6,758,503 B2 * 7/2004 Sadler ..... 292/35
2008/0148790 A1 * 6/2008 Friese et al. ..... 70/101

* cited by examiner

*Primary Examiner*—Peter M Cuomo
*Assistant Examiner*—Kristina R Fulton
(74) *Attorney, Agent, or Firm*—Klaus J. Bach

(57) ABSTRACT

In a door panel integrated door stopper with a door lock housing integrated operating mechanism, comprising a door stopper bolt, a spring biasing the door stopper bolt downwardly, a pull member connected to the door stopper bolt for actuating the door stopper bolt, the operating mechanism is disposed in the door lock housing and includes an operating member movable between door stopper engagement and release positions, the operating member extends out of the lock housing through a rear wall opening thereof so that no operating structure is disposed at the side walls of the lock housing.

3 Claims, 12 Drawing Sheets

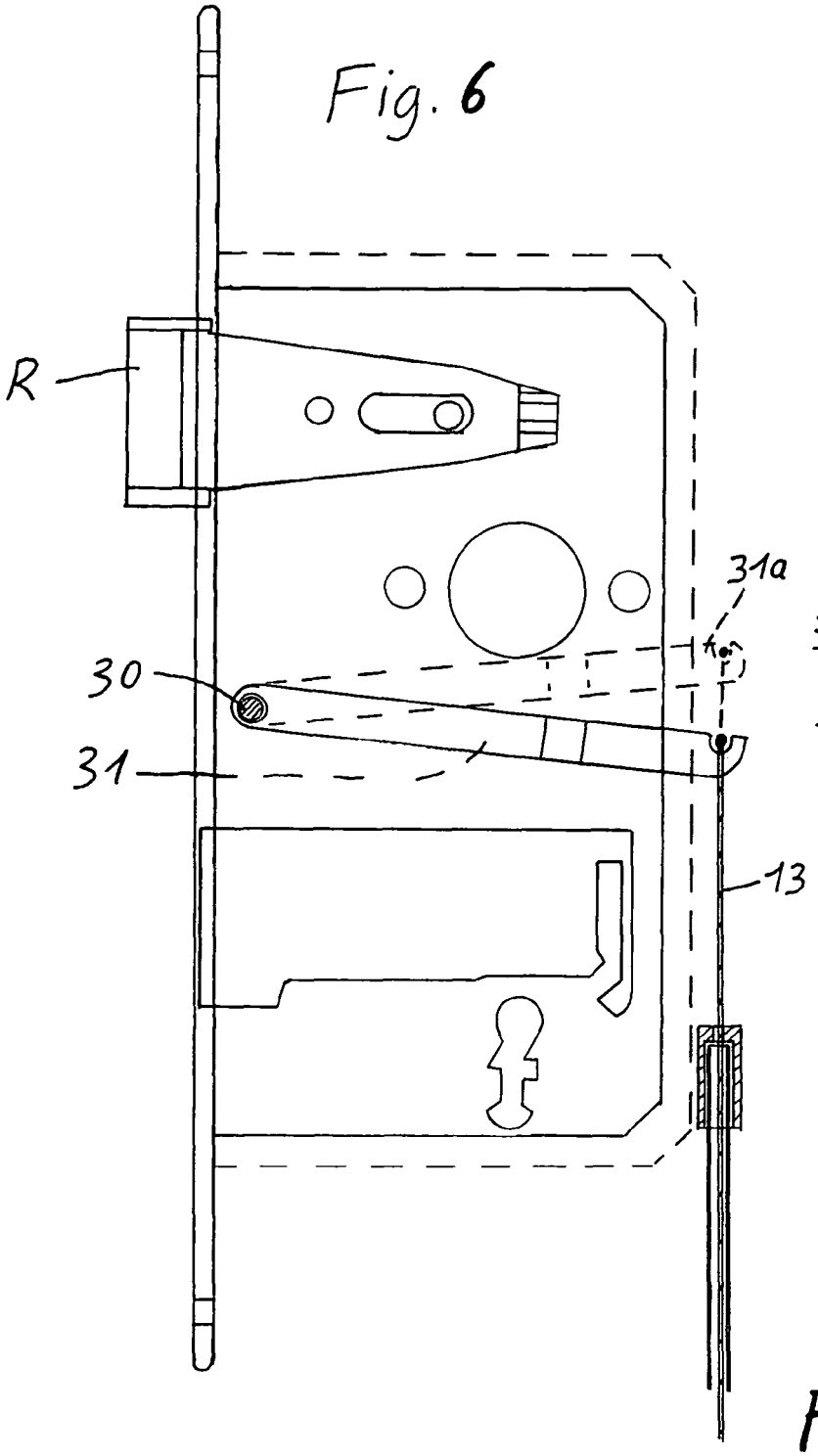
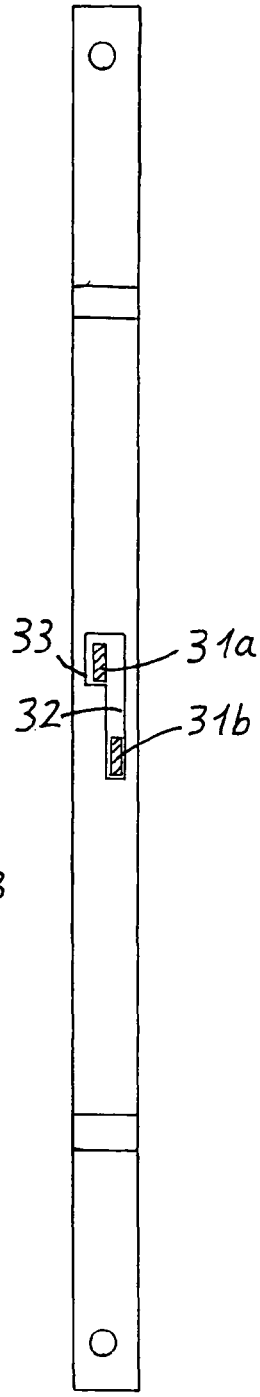
Fig. 7

R
34
35
38
36
31
37

R
34
35
38
36
37
31

DOOR PANEL INTEGRATED DOOR STOPPER WITH OPERATING MECHANISM INTEGRATED INTO THE DOOR LOCK HOUSING

BACKGROUND OF THE INVENTION

The invention relates to a door with an integrated door stopper and an operating mechanism for the door stopper which is integrated into the door lock housing.

Conventional door stoppers are usually mounted onto the door panel. They are generally designed for foot operation and generally include a bolt which is to be pushed down by a foot into engagement with an underlying floor in which position they are then locked by an engagement mechanism which can be released by a foot-actuated release lever. Those door stoppers are generally very sturdy and therefore quite voluminous so that they detract from the appearance of a door. They are therefore generally used only on house doors or other doors which need to be held open at times but not on room doors or patio or balcony doors of residential homes.

However, there is a need for door stoppers for doors in residential homes because it is often desirable to hold the doors partially or fully open for example for airing the rooms in a way which ensures that the door is not rapidly opened or closed by wind or drafts in such a way that damages occur by the door or door handle hitting for example furniture pieces or the wall causing possible glass in the door to break or the furniture to or walls to be damaged. Because of the unattractive appearance of the door stoppers in connection with interior doors, there is no demand for such door stoppers and they are therefore also not available for use in connection with interior doors, and consequently other unattractive and cumbersome devices such as wedges or cords or chains are used to hold the doors in open or partially open positions. These devices however generally do not really lock the door in a position but only prevent the door from closing, that is, they do not permit locking a door in a partially open position.

It has already been tried to integrate door stoppers into door panels. The German GM 1780520 from 1958, for example, discloses a door stopper which is to be integrated into a rabbet area of a door panel and coupled with the door handle. This door stopper includes a door stopper pin which is provided with an engagement rubber structure and is biased downwardly by a compression spring. It is coupled via an operating linkage disposed in a door rabbet with a lever arranged at the outside of the lock housing and connected to the square shaft of the door handle. When the door handle is pressed downwardly, the door stopper pin is moved upwardly against the spring force so that the door can be moved. Upon releasing the door handle, the door stopper is activated and arrests the door in its momentary position. However, this known proposed structure is not usable in practice for several reasons: For one, already the arrangement of the linkage and the lever connected to the square shaft on the outside of the door lock housing is not practical since then a free space must remain next to the door lock housing in the door panel so that the lock housing is not firmly engaged within the door panel as it is the case in the normal arrangement in which the lock housing is inserted into an opening cut into the door panel so as to tightly accommodate the lock housing. On the other hand, the arrangement is highly annoying as the door can be moved only when the door handle is pressed down which is awkward and unusual and therefore not acceptable.

Another proposal of a door panel-integrated door stopper which is also impractical is known from the German Utility Model 1 805 041, wherein again a door stopper pin provided with a braking rubber member is biased downwardly by a compression spring and includes a linkage which is disposed in a door panel rabbet and provided at its top and with a lever fork extending at opposite sides of the lock housing. When the door handle is pressed down, the door stopper pin is raised via the linkage by means of a lifting lever which is connected to the square shaft of the door handle and a spring-loaded locking finger engages the raised lifting lever so that the door stopper pin remains in the raised position and the door can be moved. For releasing the door stopper, the door handle must be moved upwardly whereby the locking finger is moved out of engagement with the lift fork. The arrangement however is such that already a slight unintentional lifting of the door handle causes the release of the door stopper resulting in an unwanted blocking of the door. The main problem however is the arrangement of the operating mechanism at both sides of the lock housing which requires space that is not available in a standard door so that a thicker door panel is needed. In addition, the free space needed at opposite sides of the lock housing in its accommodation opening in the door panel or the door rabbet for receiving the door stop mechanism results in an unstable engagement of the lock housing in the door panel.

Further, in an arrangement known from DE 1 968 078, a door stopper, which is pre-tensioned by a compression spring in a release direction, can be pressed downwardly by way of a cam lever by upward movement of the door lever, which however does not appear to be a solution which is compatible with the common door locks.

Finally, DE 1 947 291 discloses an arrangement wherein a door stopper pin which is biased downwardly by a compression spring is connected by way of a steel cable to a lever which again is arranged on the side of a door lock housing and which is operable by the door handle.

All these arrangements do not fulfill the requirements of a normal door lock housing which has a standard size so that it can be accommodated in a standard opening for firm engagement therein. They require additional cut outs in the door for which special tools and time are needed and which weaken the support and engagement of the door lock housing in the door.

It is therefore not surprising that those arrangements have not found acceptance in praxis.

It is the object of the present invention to provide a door stopper integrated into a door panel in such a way that it is practically invisible and with an operating mechanism which is integrated into the door lock housing in such a way that no spaces outside the housing need to be provided in the door panel so that commercially available door lock hardware can be used.

SUMMARY OF THE INVENTION

In a door panel integrated door stopper with a door lock housing integrated operating mechanism, comprising a door stopper bolt, a spring biasing the door stopper bolt downwardly, a pull member connected to the door stopper bolt for actuating the door stopper bolt, the operating mechanism is disposed in the door lock housing and includes an operating member movable between door stopper engagement and release positions, the operating member extends out of the lock housing through a rear wall opening thereof so that no operating structure is disposed at the side walls of the lock housing.

The door stopper is integrated into the door panel in the rabbet area so that it and the whole operating mechanism thereof is invisible from either side of the door panel and therefore does not detrimentally affect the appearance of the door. The door stopper according to the invention permits retaining of a door in a partially open position independently of any unevenness of the underlying floor in the pivot range of the door.

Since in the door stopper arrangement according to the invention, the operating mechanism is integrated into the door lock housing in such a way that no part projects sidewardly from the door lock housing, the door lock housing can be tightly accommodated and engaged in a slot cut into the door with a width adapted to the width of the door lock housing so that, on one hand, the door panel is not unnecessarily weakened and, on the other hand, the lock housing is firmly engaged in the door panel. And since the operating mechanism for the door stopper is coupled to the connecting members of the operating mechanism and the door stopper bolt in the rear of the lock housing, the slot in the door panel receiving the door operating mechanism housing only needs to be cut somewhat deeper, which however does not affect the tight fit of the lock housing in the door panel.

It is noted that the door stopper according to the invention cannot only be used for holding a door in a particular position, but also as a security lock for securely locking a door in a closed position. Furthermore, a locking structure may also be provided at the top of the door for additionally locking the door to the door frame at the top of the door in order to make the door even more break-in resistant.

Various embodiments of the invention will be described below on the basis of the accompanying drawing.

BRIEF DESCRIPTION OF THE DRAWINGS

FIG. 6 to FIG. 11 show a mechanism wherein the door stopper is operated by the door handle.

DESCRIPTION OF VARIOUS EMBODIMENTS

Figure 1:
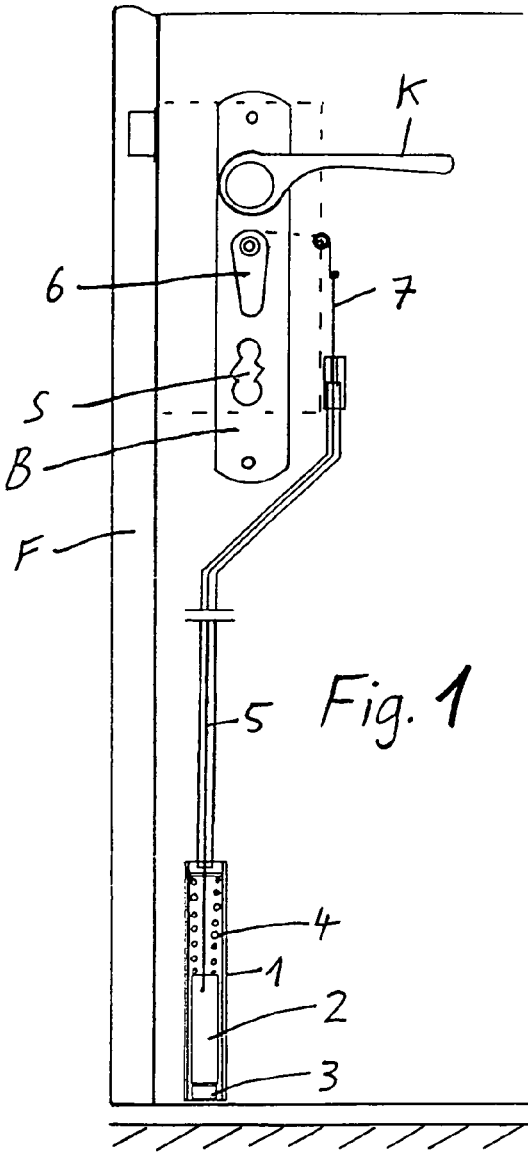
FIG. 1 to FIG. 5 show an embodiment of the door stopper with an operating mechanism integrated into the door lock housing and an operating lever disposed on the lock hardware panel.

The door stopper according to the invention includes a housing 1 installed in the lower area of the door panel with a door stopper bolt 2 and a door stopper foot 3 and a compression spring 4 biasing the door stopper bolt 2 downwardly. By way of a connecting member 5, preferably in the form of a Bowden Cable, the door stopper bolt 2 is connected to an operating mechanism arranged in the lock housing of the door.

Figure 2:
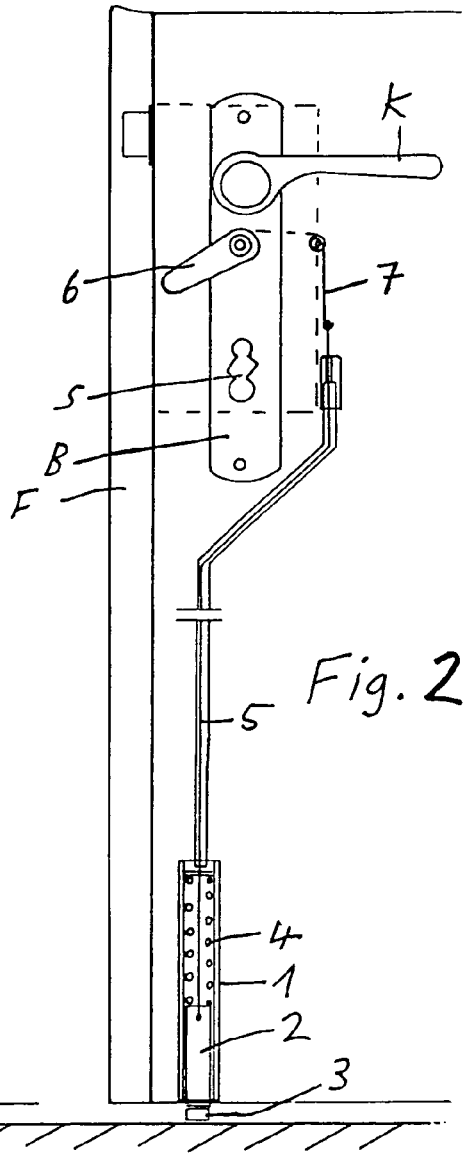
Figure 3:
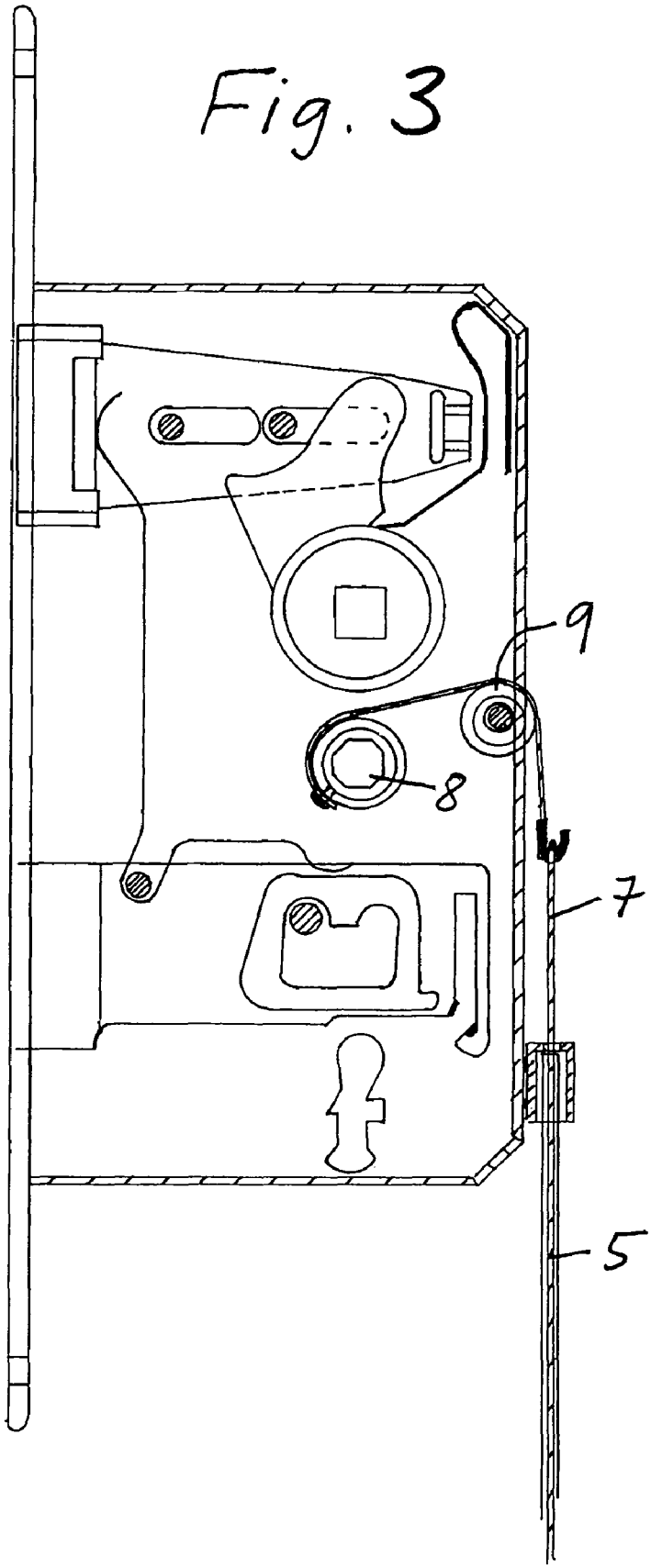
Figure 5:
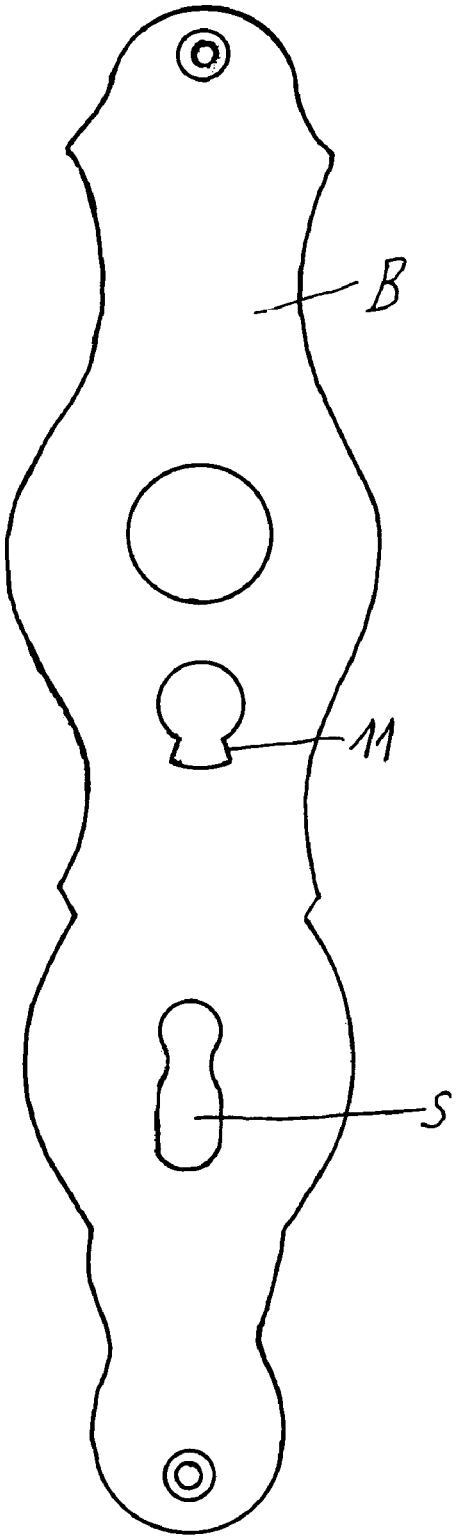
Figure 4:
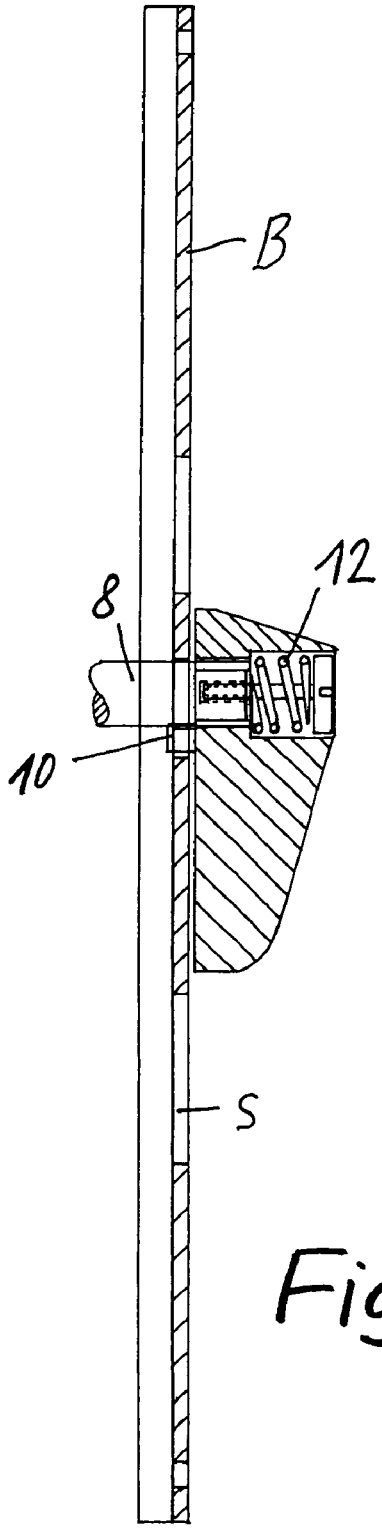

In the embodiment shown in FIGS. 1 to 5, the operating mechanism for the door stopper includes an operating lever 6 disposed at the door fitting B. FIGS. 1 and 2 show the arrangement in the door release or rest position or, respectively, in the operating position of the door stopper. FIG. 3 shows the operating mechanism for the door stopper in the door lock housing while FIG. 4 shows the door stopper mechanism operating lever 6 on the door fitting B and FIG. 5 is a plane view of the door fitting B modified to accommodate the door stopper mechanism operating lever 6 with its shaft extending through the modified fitting B into the door lock housing.

The FIGS. 1 and 2 each show a door panel with a door rabbet F, a door fitting B, a door handle K, a keyhole S in the door fitting B and the operating lever 6 arranged on the door fitting B below the door handle K. The operating lever 6 is connected to a pull cable 7 of the Bowden cable 5 for actuating the door stopper bolt 2. Instead of a Bowden cable 5 with a pull cable 7, another pull member can be used, of course.

FIG. 1 shows the door stopper in the rest position that is the release position in which the door stopper bolt is raised. In this position, the operating lever 6 points vertically downwardly.

FIG. 2 shows its operating position that is the position in which the stopper bolt is lowered onto the floor. In this position, the operating lever 6 is pivoted out of its rest position toward the left as shown in FIG. 2.

FIG. 3 is a cross-sectional view of the door lock, wherein, in cross-section, also a shaft 8 is shown onto which the operating lever is firmly mounted for rotation therewith. At the circumference of the shaft 8, the pull cable 7 is attached. The diameter of the shaft 8 may be increased by a roller 8' which is disposed thereon and to which the pull cable 7 is attached. The pull cable then extends about a reversing roller 9 and out of the lock housing.

FIG. 4 shows the operating lever 6 with the door fitting B in a cross-sectional side view. FIG. 5 shows only the fitting B in a planar view. As apparent from these figures, the operating lever 6 is provided at its side facing the fitting B with a projection 10 and the fitting B has a corresponding complementary cut-out 11, which in the embodiment shown is in the form of a side extension in the bore receiving the shaft 8 but which may also be in the form of a separate opening. In the rest position, that is when the door stopper bolt 2 is raised, the projection 10 extends into the cut out 11 so as to lock the operating lever in that position.

For operating the door stopper, the operating lever 6, which is mounted on the shaft 8 for rotation therewith, is axially movable against the force of a spring 12 away from the fitting B so that the projection 10 is moved out of the cutout 11 whereby the operating lever 6 becomes rotatable together with the shaft 8 into the position as shown in FIG. 2. Since the door stopper bolt 2 is subjected to the force of the compression spring 4, the door stopper bolt 2 is moved to its operating position in which the door stopper foot engages the floor as soon as the operating lever 6 is released. The operating lever 6 is then held in its pivoted position by the pull cable 7 which is connected to the stopper bolt 2. For returning the door stopper to its rest position with the door stopper bolt 2 raised, the operating lever 6 is again returned to its vertically downward pointing position in which the projection 10 snaps again into the cutout 11 under the force of the spring 12, which biases the operating lever into the locked position.

FIGS. 6-11 show an embodiment wherein the door stopper is operated by the door handle K. FIG. 6 shows the door key bolt R operated by the door handle in a side view and FIG. 7 shows the lock in a rear view. Installed in the door lock is a lever 31, which is supported at its front end so as to be pivotable about axle 30 and which extends backwardly out of the lock housing. Its rear end is connected outside the lock housing to a pull cable 7 which may again be a Bowden cable 13. The rear view of the lock of FIG. 7 shows that the rear end wall of the lock housing includes a vertical slot 32 for guiding the rear end of the lever 31. At its upper end, the slot 32 is provided with a side engagement opening 33, in which the lever is received in the rest position of the door stopper (this position is indicated by the numeral 31*a*). The lower position of the lever 31 at the bottom end of the slot 32 is indicated by the reference numeral 31*b*. The lever 31 is resiliently biased in the direction toward the engagement opening 33. If the lever 31 is moved in the slot 32 out of its lower position to the upper position, it automatically enters the engagement opening 33. The FIGS. 8-11 each show the door lock in cross-section with the operating mechanism for the door stopper installed therein in different operating positions which will be explained below.

On the square shaft, which is rotatable by the door handle, an actuating member 34 is arranged for moving the key bolt R against its spring bias in opening direction. This actuating member 34 is elongated by a disc-like part with a curved (or straight) slot 35 shown in the FIG. 8 to extend clockwise, and ends at the bottom in a cam 36. The cam 36 is disposed directly adjacent the lever 31 and the lever 31 includes a projection 37 extending toward the cam 36, that is, the projection 37 which extends between the two transverse edges forms an inclined ramp area between the sidewardly displaced main surface areas of the sections of the lever 31 in front and behind the projection 37.

Figure 8:
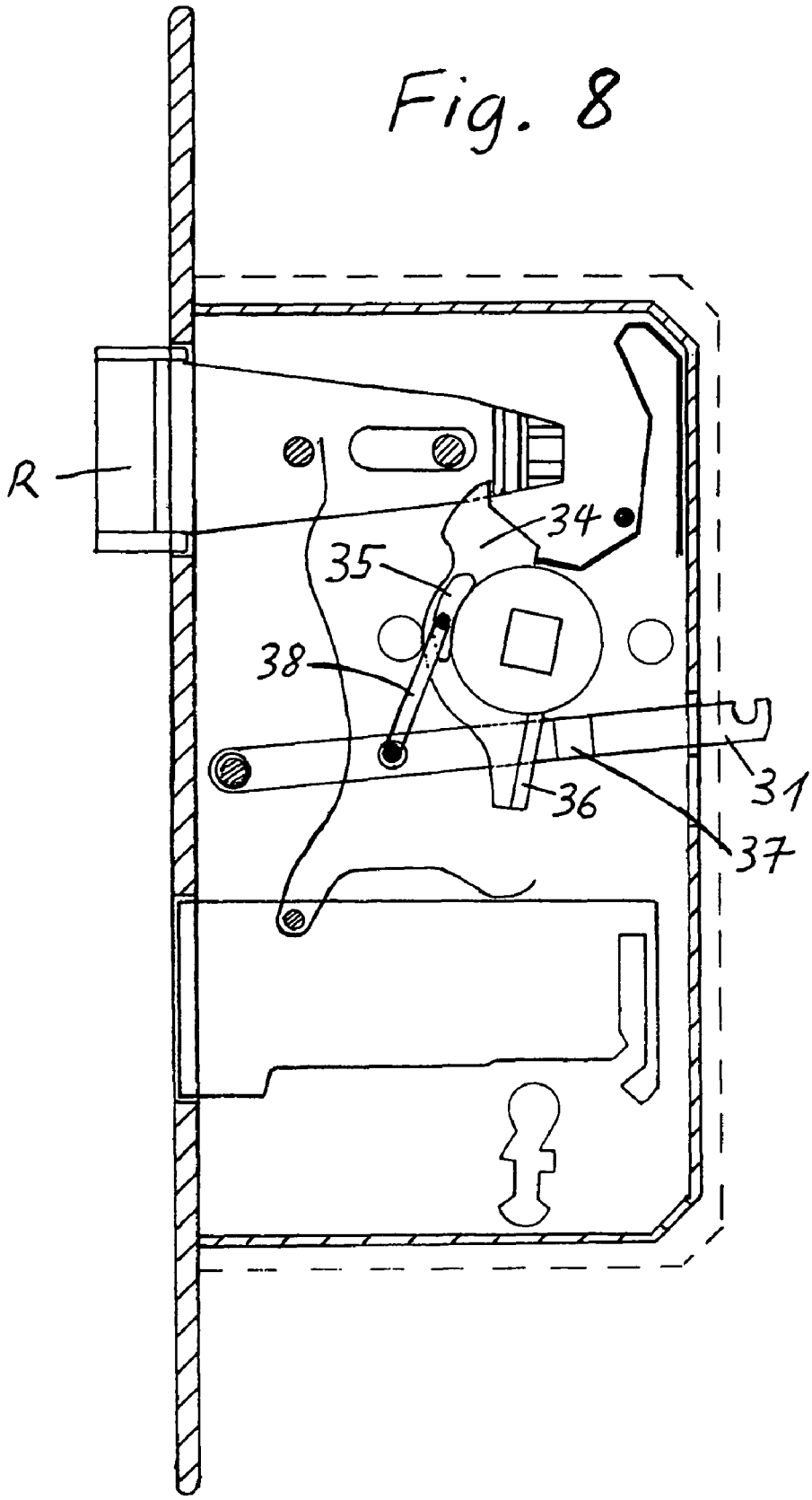

FIG. 8 shows the "neutral" position of the door lock, in which the door handle and the door stopper are in a rest position with the door stopper bolt raised. The lever 31 is pivoted upwardly and is received in the engagement opening 33.

Figure 9:
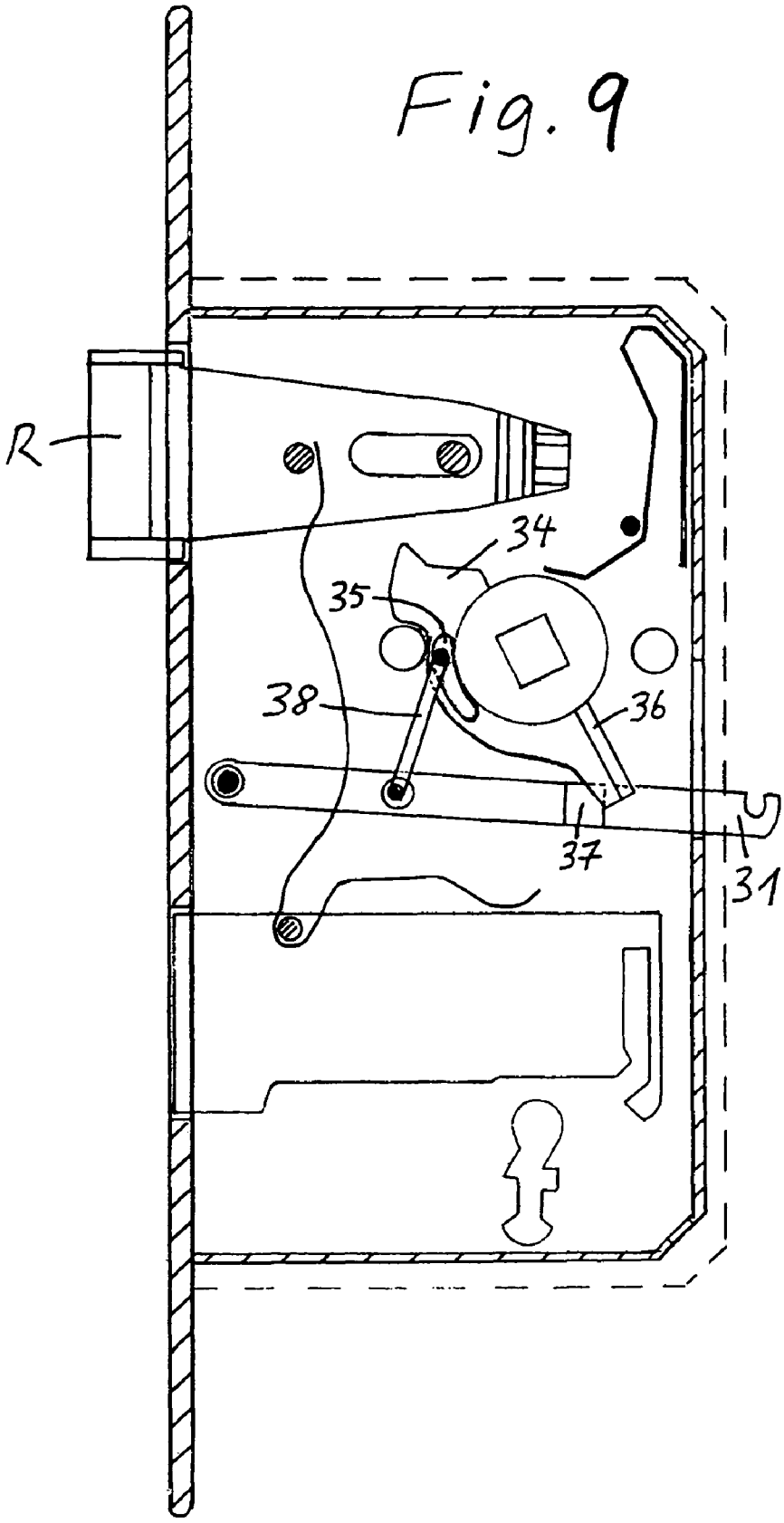
Figure 10:
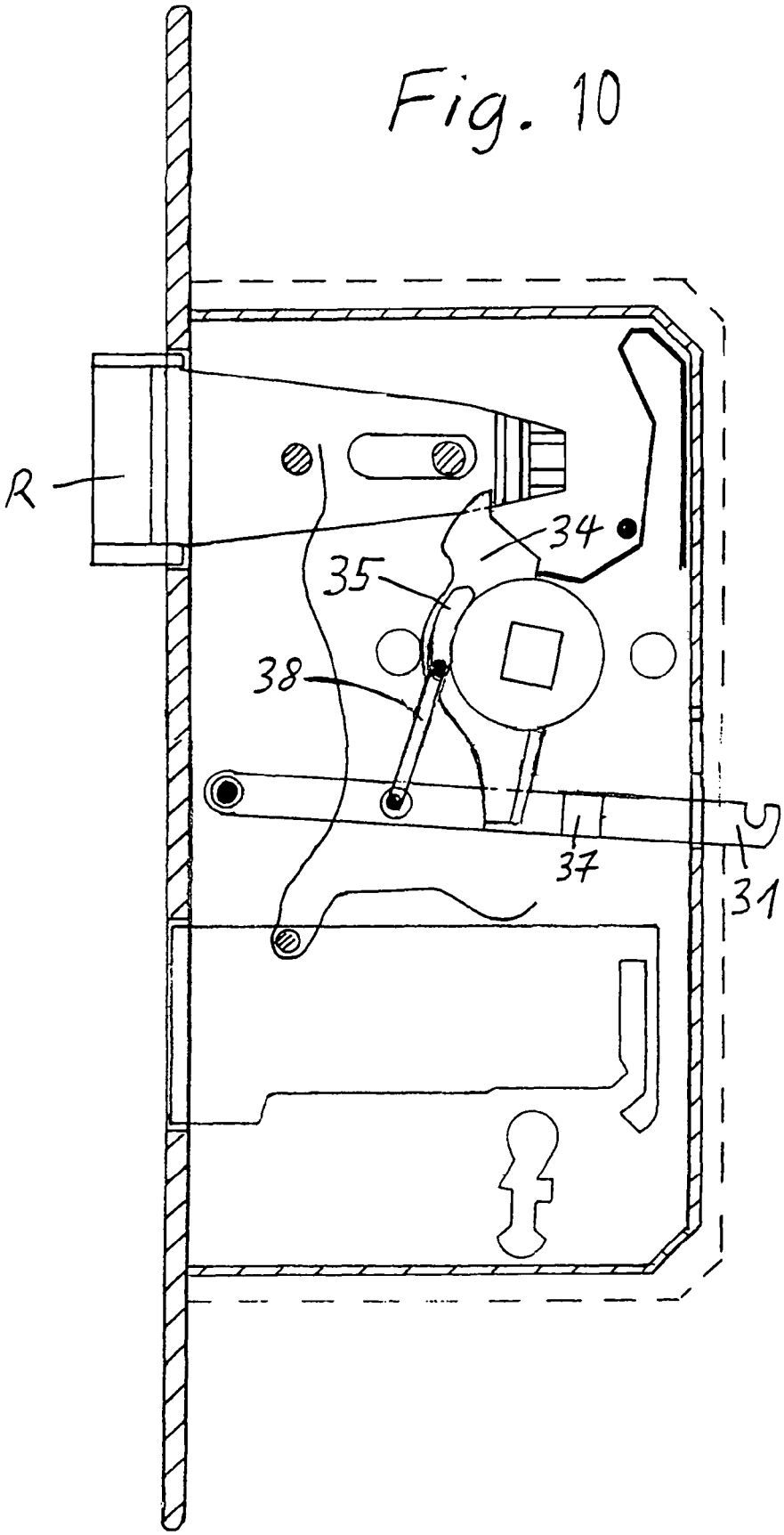

When the door stopper is to be moved to an operating position with the door partially or fully opened, the door handle is tilted slightly upwardly that is opposite to the door opening direction. The square shaft with the actuating member 34 and the cam 36 is then turned counterclockwise (in the figure). This position is shown in FIG. 9. In this process, the cam 36 is moved along the projection 37 of the lever 31 and moves it sidewardly out of the engagement opening 33 (FIG. 7) so that the lever 37 can move down in the slot 32 to its lower position 31*b* in which position it is shown in FIG. 9. After its release, the door handle returns to its normal rest position but, contrary to the neutral position shown in FIG. 8 where the lever 31 is engaged in its upper position, the lever 31 is now in its lower position and the door stopper is lowered into engagement with the underlying floor (FIG. 10).

Figure 11:
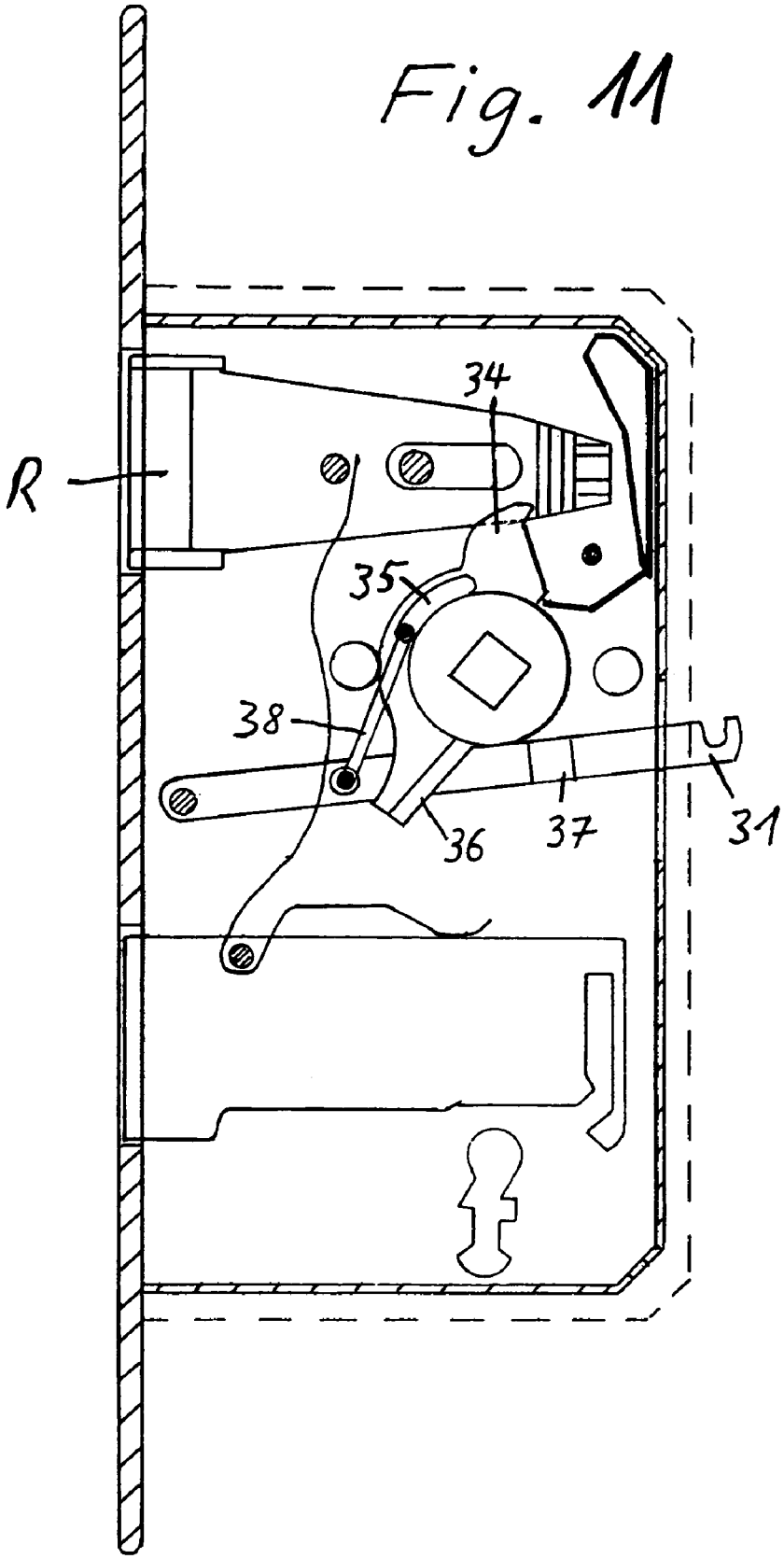

For releasing the door, that is raising the door stopper, the door handle is to be pivoted to a door opening position just like for opening the door. This is shown in FIG. 11. As shown in FIGS. 8-11, the lever 31 is connected to the actuating member 34 by an operating link or operating member 38 which is slidably received in a slot 35 of the actuating member 34. When, as shown in FIG. 11, the door handle is pivoted in door opening direction, the actuating member 34 is rotated by the square shaft clockwise (in the figure), that is, the lower end of the slot 35 is moved upwardly together with the opening link 38 whereby the lever 31 is pulled upwardly to its upper end position where it snaps again into the engagement opening 33. The lever 31 at the same time pulls the pull cable 7 (FIG. 6) upwardly and lifts the stopper bolt 2 with its foot 3 out of engagement with the floor and into its rest position. The door handle can then be released that is returned to its neutral position as the lever 31 is now engaged in its upper position (FIG. 7, 31*a*) and the door can be freely moved.

Figure 12:
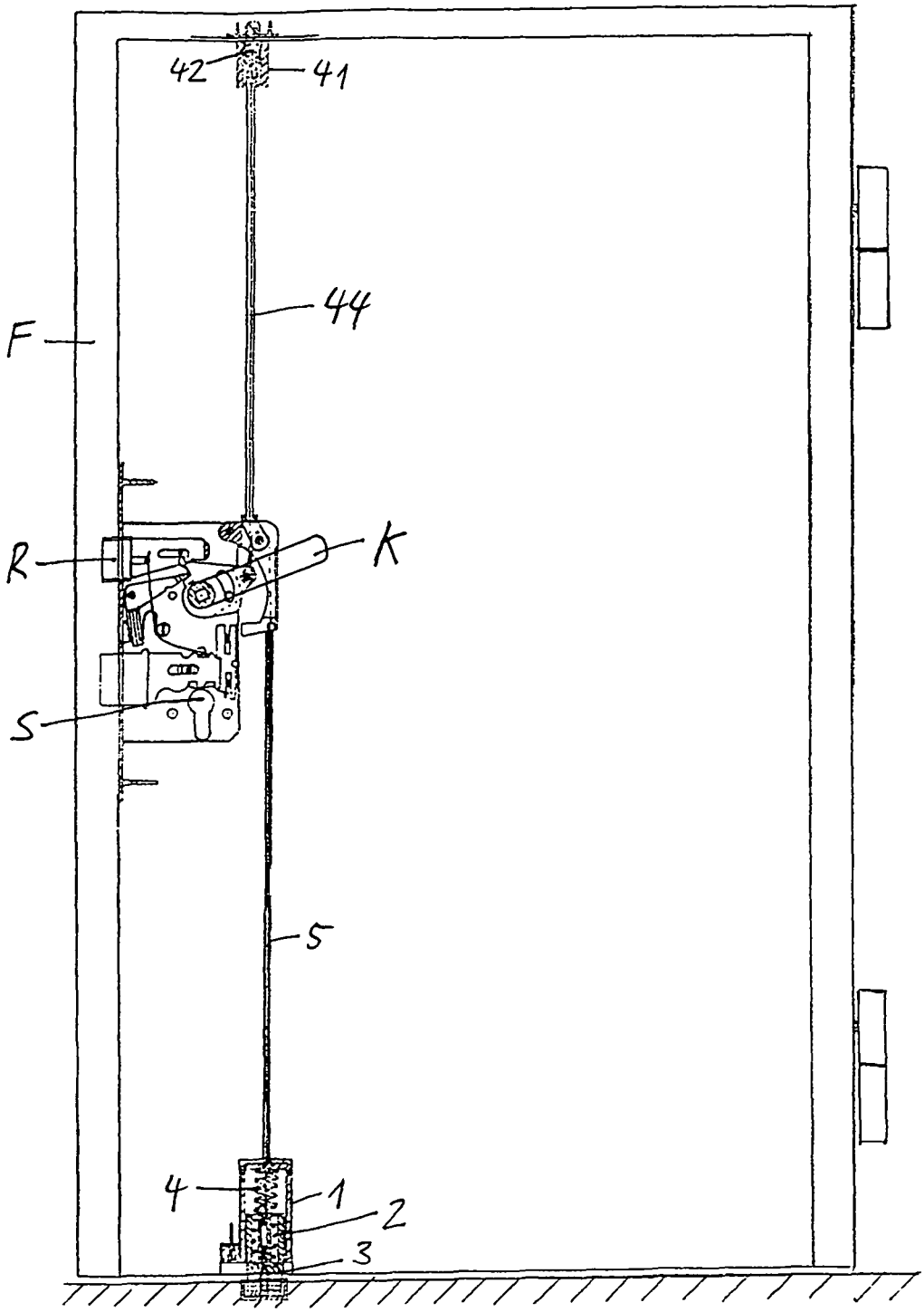
FIG. 12 is a sectional view of a door panel with a locking bolt arrangement including a floor as well as a top frame locking bolt.

FIG. 12 shows the interior of a door including the door stopper mechanisms described above which, in this case however, is expanded to a double door locking mechanism and provides for a locking of the door in the closed position at the bottom and the top of the door. In this case, the stopper bolt extends into an opening in the floor and an upper locking bolt extends into an opening in the door frame above the door. When the door is open or partially open the door stopper can be operated in any desired door position for holding the door by the door stopper in the desired position. The FIGS. 13 and 14 show the door lock-integrated operating mechanism, the door stopper and the upper door locking bolt (without door panel) in an enlarged representation and FIG. 15 shows the operating mechanism for the upper locking bolt—without the door stopper—in a further enlarged representation in order to more clearly show the details the operating mechanism.

Figure 13:
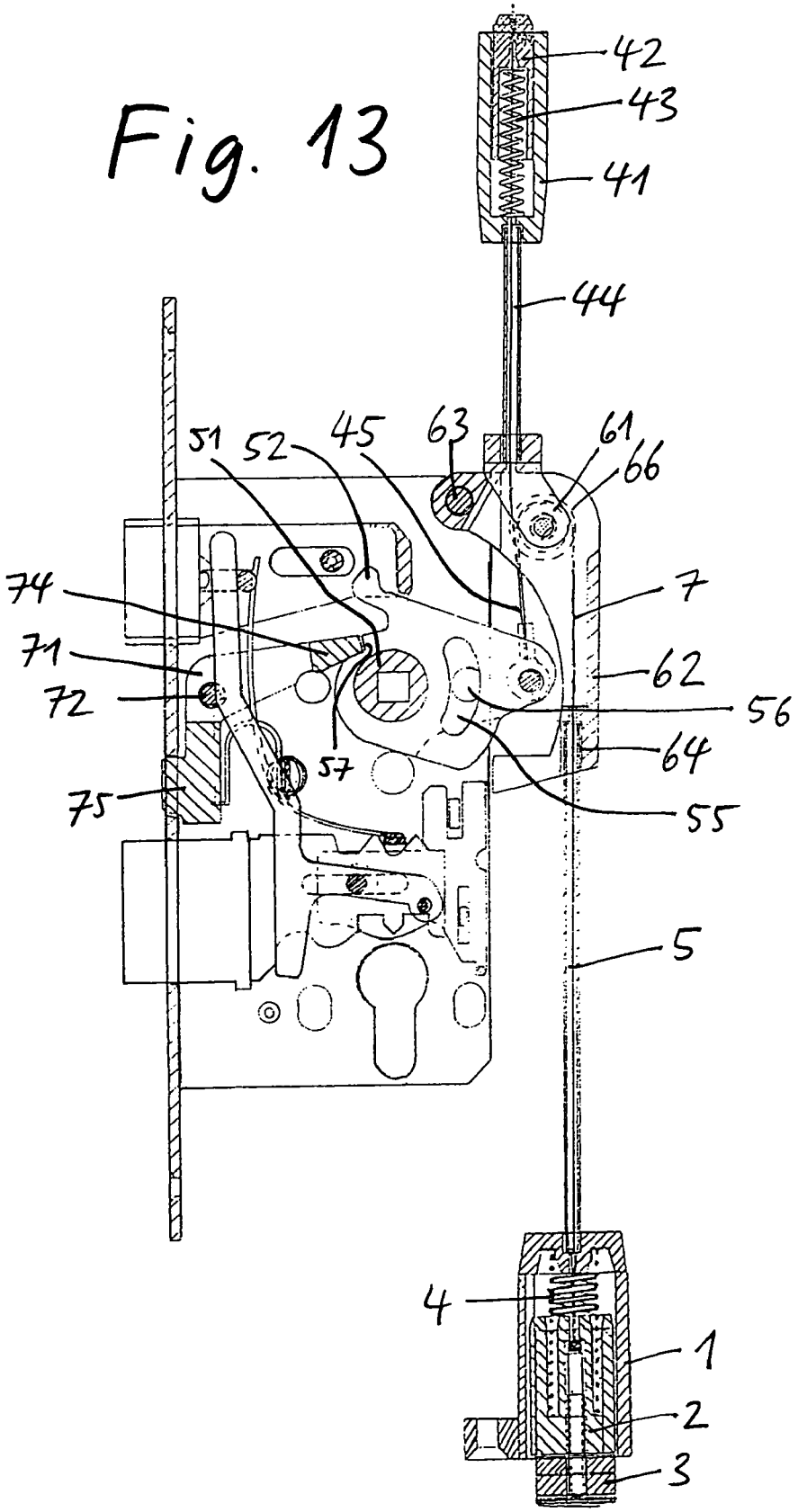
FIG. 13 and FIG. 14 show a door bolt locking arrangement in a locking position and in a release position.
Figure 14:
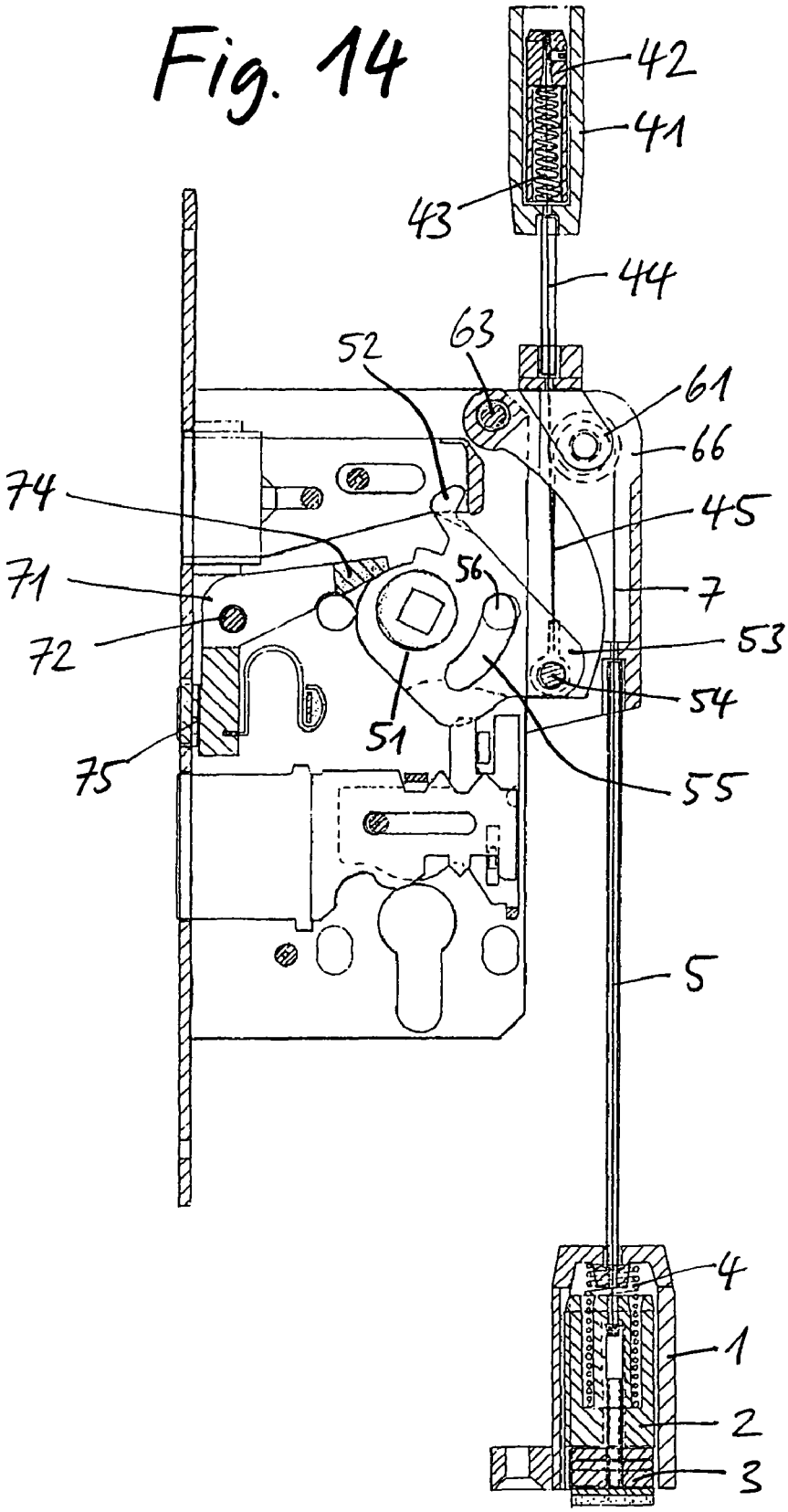

FIG. 13 shows the arrangement with the door handle in the rest position and FIG. 14 shows the arrangement with the door handle pushed down. Like in the previously described embodiment, the door stopper comprises a housing 1 with a door stopper bolt 2 including a stopper foot 3 movably disposed in the housing and biased downwardly in a door holding position by a compression spring 4. A connecting member in the form of a Bowden cable 5 extends upwardly to the operating mechanism in the door lock. The door lock mounted into the top of the door is of similar design and comprises a housing 41, a locking bolt 42 slidably disposed in the housing 41, a compression spring 43 biasing the locking bolt 42 into its locking position and a connecting member in the form of a Bowden cable 44 extending to an operating mechanism in the door lock.

Figure 15:
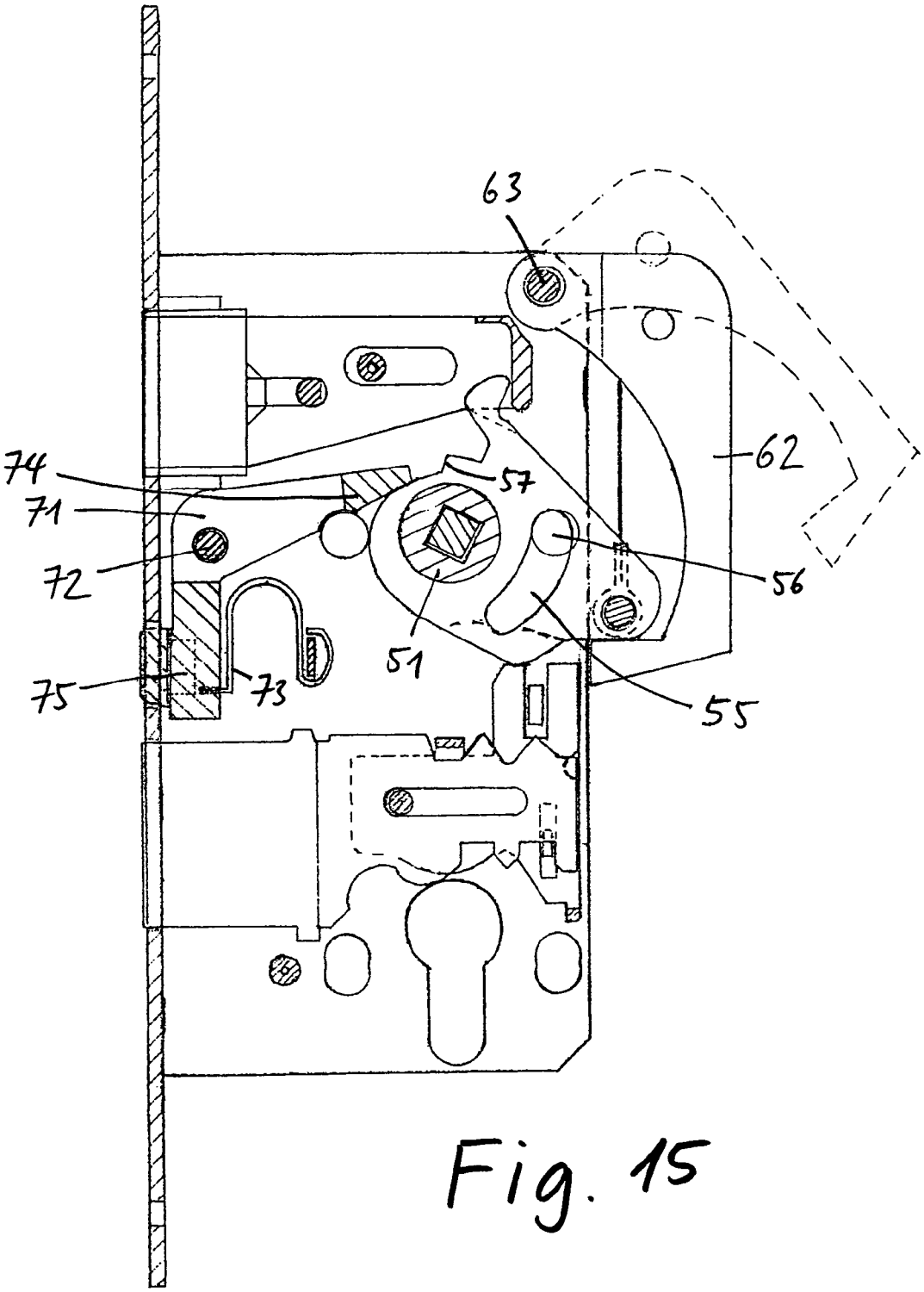
FIG. 15 shows the locking mechanism of FIGS. 12-14 in an enlarged representation.

In accordance with FIGS. 13 to 15, the lock-integrated operating mechanism includes a modified button 51, which is rotatable by the door handle via the square shaft. The button 51 carries not only an operating member 52 for actuating the catch lock bolt R but also an operating lever 53, which extends backwardly out of the lock housing and to which the pull cable 7 of the Bowden cable 5 as well as the pull cable 45 of the Bowden cable 44 are attached. Here, the pull cable 7 connected to the door stopper extends over a reversing roller 61, which is supported by a pivot housing 62 and then downwardly to the common connecting point 54. The pivot housing 62 is pivotally supported in the rear upper corner area of the lock housing by a pivot joint 63 so as to be pivotable about a horizontal axis. At its lower end, the pivot housing 62 includes an engagement structure 64 for the end of the Bowden cable 5. At the upper end of the pivot housing 62, a connecting structure 65 is provided for the attachment of the Bowden cable sleeve of the Bowden cable 44, preferably by means of the shaft of the reversing roller 61. By upward pivoting of the pivot housing 62 about the pivot joint 63, the pull cable 7 of the Bowden cable 5 can easily be placed over the reversing roller 61 and attached to the lever 53 and also the Bowden cable sleeve of the Bowden cable 5 can be attached to the engagement structure 64. In its upper area, the pivot housing 62 is provided with a slot 66 through which the pull cable 45 of the Bowden cable 44 extends. In this way, also the pull cable 45 can be easily attached to the operating lever 53.

The operating lever 53 is part of a flat disc member which is connected to the button 51 and includes a curved guide slot 55 into which a pin 56 extends so that the operating lever 53 is pivotable over a certain pivot range which is limited by the guide slot 55. In addition, the disc member carried by the button 51 has in its front area a recess so that a stop 57 is formed. In the front area of the lock housing, an angled lever 71 is rotatably supported by a joint pin 72 and is biased by a spring 73 in a rotational sense so that the arm 74 of the angled lever 71 is pressed toward the button 51. The other lever arm forms a pressure sensor which extends into a corresponding opening of the cover fitting of the lock housing so that it can be operated from outside by a finger.

FIG. 13—as already mentioned—shows the arrangement with the door handle in a rest position. The locking bolt 42 and the door stopper bolt 2 extend from the respective housings 1 or respectively, 42 but only to an extent that the pivoting of the open or partially open door is not prevented. On the door frame and in the floor below the door for example plates provided with a ramp or similar structures with a lock bolt receiving opening are so arranged that, upon closing of the door, the locking bolt foot 3 and the locking bolt 4 are pushed by the ramp against the forces of the respective compression springs 4, 43 back into their respective housings and, upon closing of the door, move into the respective locking bolt receiver opening.

FIG. 14 shows the arrangement with the door handle pressed down. The button 51 is pivoted together with the lever 53 in clockwise direction until further movement is limited by contact with the pin 56. In the process, the Bowden cables 5, 44 of the door stopper bolt 2 and the locking bolt 42 are pulled in so that the door can be opened. This occurs automatically since the door handle has to be pushed down for opening the door in order to pull the catch bolt back. The door can consequently now be opened without problem. When the door handle is returned to its normal position, the locking bolt 42 and the door stopper bolt 2 move again slightly outwardly but only so far that the movement of the door is not obstructed. If the door is to be arrested by the door stopper pressing the lever arm 75 of the angled lever 71 inwardly causes the lever arm 74 to move out of its engagement with the stop 57 of the button 51 so that the button can pivot counter clockwise until the lower end of the guide slot 55 abuts the pin 56. This pivot movement of the button 51 occurs as a result of the force of the springs 5 on 43 which pre-tension the door stopper bolt 2 and the locking bolt 42 and tension the pull cables 7 and 45, which tension forces are transmitted to the lever 53. While the locking bolt 42 moves further upwardly without any effect the door stopper bolt 2 engages with its foot 3, the underlying floor and arrests the door in its momentary position. Because of the forward movement of the button 51, the door handle is pivoted into an upwardly inclined position so that the actuation of the door stopper is indicated by the door handle. Upon pushing down the door handle, the door stopper is returned to its normal position and the lever arm 74 is again engaged by the stop 57 of the button 51, which has been pivoted back together with the door handle and the door is again freely movable.

Other than in the embodiment described above, the arrangement may be such that the locking bolt 42 and the stopper bolt foot 3 are not automatically engaged when the door is closed so that then no guide ramps are needed for the bolt accommodation openings. Instead a member may be provided in the form of a push button or a lever which is operable from the lock cover plate by which the lever arm 74 or another locking member can be removed from the recess in the button 51 forming the stop 57 in order to cause the movement of the locking bolt 42 and the stopper bolt foot 3 into the bolt accommodation openings. Also, in this case, the door handle would assume an upwardly inclined position so as to signal the locked state of the door. And also in this case, the locking of the door would automatically be reversed as the door handle is pushed down for opening the door.

What is claimed is:

1. A door panel integrated door stopper with a door lock housing integrated operating mechanism comprising:

a door stopper bolt with a bolt foot movably supported in a bolt housing, a spring engaging the door stopper bolt so as to bias the door stopper bolt downwardly out of the housing, a pull member connected to the stopper bolt and extending to an operating mechanism for actuating the door stopper bolt against the force of said spring, said operating mechanism being disposed in the door lock housing of a door and including an operating member movable between a first stable position thereof corresponding to a release position of the door stopper bolt and a second stable position corresponding to an operating position of the door stopper bolt, said operating member projecting out of the lock housing through a rear wall of the lock housing and being connected to the pull member for actuating the door stopper bolt, the door lock housing including a door handle for actuating also the operating mechanism for the door stopper bolt, the operating member comprises an operating lever extending rearwardly out of the door lock housing and the pull member connected to the lever at the rear of the door lock housing, the operating lever of the operating mechanism disposed in the door lock housing being pivotally supported at the front area of the door lock housing and the rear end extending through a guide slot in the rear wall of the door lock housing, said guide slot having a top end provided with an engagement opening in which the operating lever is resiliently accommodated for retaining the operating lever in an upward pivoted position in which the stopper bolt is held in a raised position, said door handle being mounted onto a rotatable square shaft carrying also an actuating member with a cam and the operating lever having a side projection by which the operating lever, upon lifting of the door handle out of its normal position, can be moved by the cam sidewardly out of the engagement opening, and a coupling member extending between the operating lever and the actuating member for moving the operating lever upwardly to be retained in the engagement opening upon downward movement of the door handle.

2. A door stopper according to claim 1, wherein a top lock bolt is provided at the top of the door and is movably disposed in a housing including a spring (43) for biasing the top lock bolt upwardly and another pull member extends between the top lock bolt (42) and the operating member.

3. A door stopper according to claim. 1, wherein the pull member is a pull cable of a Bowden cable.

* * * * *